US005087944A

United States Patent [19]

Yamauchi

[11] Patent Number: 5,087,944

[45] Date of Patent: Feb. 11, 1992

[54] IMAGE FORMING APPARATUS WITH CONTROL MEANS FOR THE SURFACE POTENTIAL OF A PHOTOSENSITIVE BODY

[75] Inventor: Shin Yamauchi, Tokyo, Japan

[73] Assignee: Kabushiki Kaisha Toshiba, Kawasaki, Japan

[21] Appl. No.: 517,029

[22] Filed: May 1, 1990

[30] Foreign Application Priority Data

May 31, 1989 [JP] Japan ..... 1-138848

[51] Int. Cl.[5] ..... G03G 15/02

[52] U.S. Cl. ..... 355/225; 355/221; 355/239; 361/235

[58] Field of Search ..... 355/221, 225, 226, 219, 355/239; 361/225, 235

[56] References Cited

U.S. PATENT DOCUMENTS

| | | | |
|---|---|---|---|
| Re. 30,535 | 3/1981 | Kuroishi et al. | 355/265 |
| T890,003 | 9/1971 | Kaukeinen | 355/221 X |
| 3,843,906 | 10/1974 | Leibrecht | 361/235 |
| 4,086,650 | 4/1978 | Davis et al. | 361/229 |
| 4,248,518 | 2/1981 | Nishikawa | 355/225 |
| 4,251,152 | 2/1981 | Miyakawa et al. | 355/225 X |
| 4,491,407 | 1/1985 | Mitsuyama et al. | 355/219 X |
| 4,585,320 | 4/1986 | Altavela et al. | 355/221 X |

FOREIGN PATENT DOCUMENTS

| | | |
|---|---|---|
| 1154225 | 6/1969 | 4225 . |
| 1563173 | 1/1972 | Fed. Rep. of Germany . |
| 2630762 | 2/1977 | Fed. Rep. of Germany . |
| 0131275 | 6/1987 | Japan . |

OTHER PUBLICATIONS

European Search Report.

*Patent Abstracts of Japan,* vol. 5, No. 81; & JP-A-5629260.

*Patent Abstracts of Japan,* vol. 10, No. 264; & JP-A-6188283.

*Primary Examiner*—A. T. Grimley

*Assistant Examiner*—Nestor R. Ramirez

*Attorney, Agent, or Firm*—Foley & Lardner

[57] ABSTRACT

An equal voltage is applied to a corona shielding case and a screen grid, when a normal mode is set, while a switch is changed over to connect the shielding case to ground when a photo mode is set. Therefore, part of a discharge voltage from a corona discharger is grounded in the photo mode. It is therefore possible to make the surface potential of a photosensitive body in the photo mode in which the shielding case is grounded lower than that in the normal mode in which the shielding case of the corona discharger is placed at a potential corresponding to an output direct-current voltage of a high-tension transformer. As a result, half-tones of photographs can be reproduced effectively.

11 Claims, 5 Drawing Sheets

IMAGE FORMING APPARATUS WITH CONTROL MEANS FOR THE SURFACE POTENTIAL OF A PHOTOSENSITIVE BODY

BACKGROUND OF THE INVENTION

1. Field of the Invention

The present invention relates to an image forming apparatus, and, more particularly, a device for controlling the surface potential of a photosensitive body used in an image forming apparatus, such as an electronic copying machine.

2. Description of the Related Art

In general, where photographs are copied by electronic copying machines, the resulting copied images will lack halftones, i.e., gray level. This is due to the surface potential of the photosensitive body.

Accordingly, an electronic copying machine has been developed which has a dedicated photo mode in which photographs are to be copied, as well as a normal mode in which originals other than photographs are to be copied. This type of electronic copying machine is constructed to make the surface potential of the photosensitive body in the photo mode lower than that in the normal mode, thereby improving the reproducibility of halftones.

Usually, in order to control the surface potential of the photosensitive body in the photo mode, an output value of a charging transformer is feedback controlled by means of a central processing unit (CPU).

With such an arrangement, however, a feedback control transformer and a feedback circuit are required, thus increasing manufacturing cost.

As described above, an electronic copying machine which feedback controls an output value of a charging transformer to control the surface potential of a photosensitive body has a drawback in that it is costly because of the need of a feedback control transformer and a feedback circuit.

A related invention is described in U.S. Ser. No. 466,586, filed on Jan. 17, 1990.

SUMMARY OF THE INVENTION

It is an object of the present invention to provide a device for controlling the surface potential of a photosensitive body inexpensively without a feedback control transformer and a feedback circuit.

To achieve the object, there is provided a device for controlling the surface potential of a photosensitive body comprising:

- an image carrier having a surface on which an electrostatic latent image is formed;
- charging means disposed to face the surface of said image carrier for charging the surface thereof;
- bias voltage supply means disposed around said charging means for causing said charging means to corona discharge so as to apply a direct-current voltage to said image carrier to thereby charge said image carrier; and
- bias voltage switching means for switching a bias direct-current voltage applied to said bias voltage supply means between at least two voltage levels.

In an embodiment of the present invention, a device for controlling the surface potential of a photosensitive body comprises an image carrier having a surface on which an electrostatic latent image is formed; a charger for charging the surface of the image carrier; an electrically conductive shield for covering the charger; a grid for preventing nonuniform charging of the surface of the image carrier which is caused by the charger; supply means for supplying a voltage to the grid and the shield; control means for switching the voltage applied to the shield by the supply means between at least two voltage levels; and switching means for causing the control means to switch the voltage level.

According to the present invention, the voltage applied to the shield is lowered by the above-described means so that the quantity of charge on the image carrier can be lowered.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENT

An embodiment of the present invention will now be described with reference to the accompanying drawings.

Figure 1:
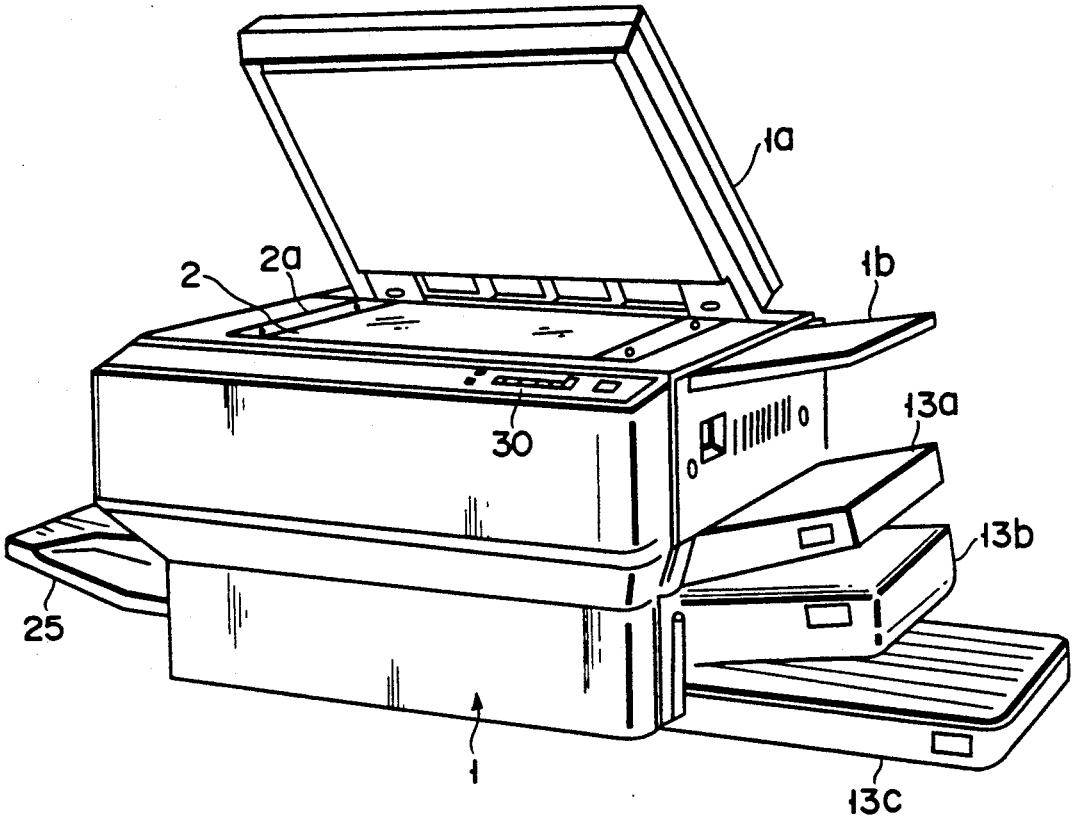
FIG. 1 is an outer perspective view of an image forming apparatus using a surface potential controlling device for a photosensitive body of the present invention.
Figure 2:
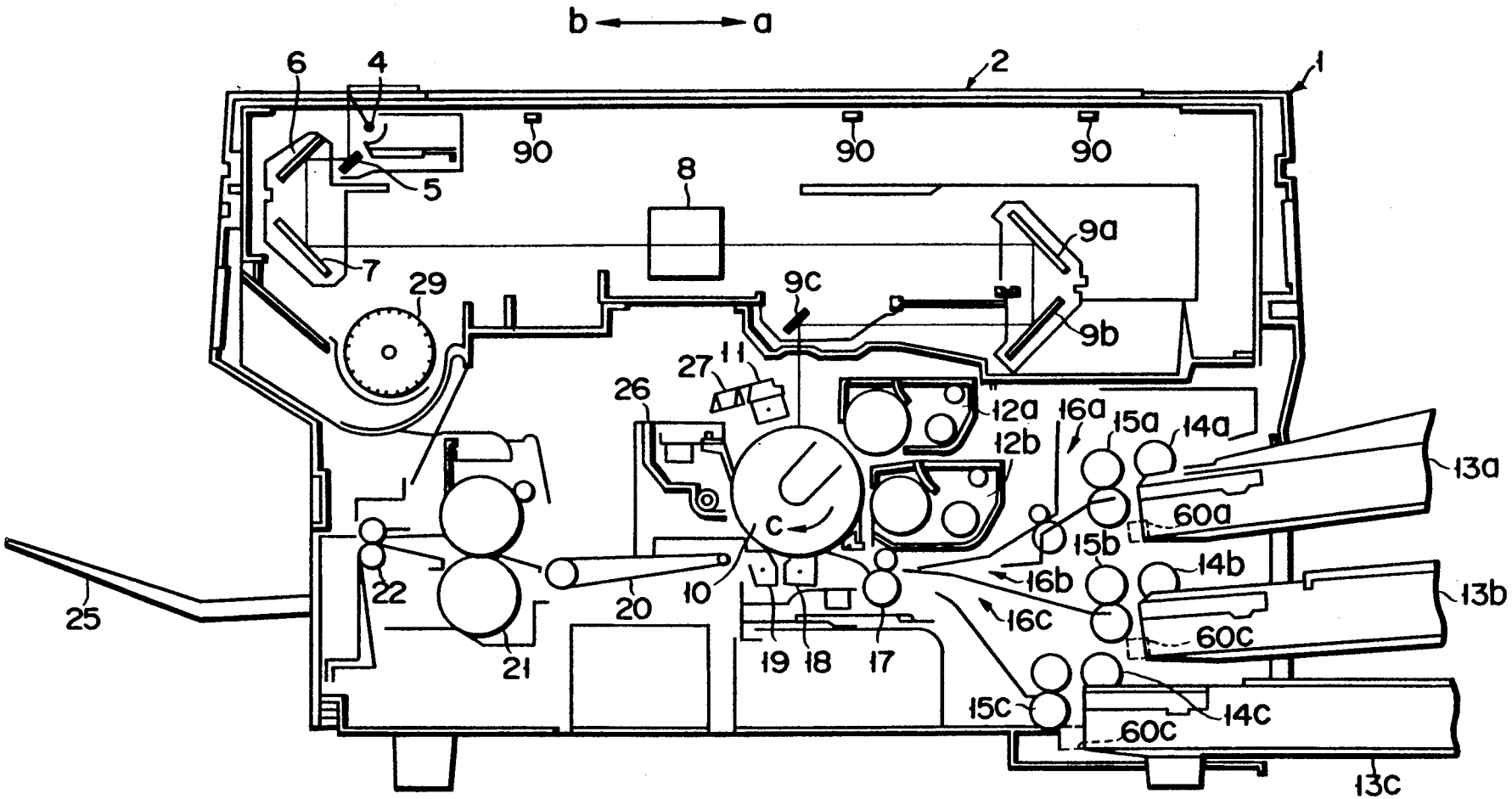
FIG. 2 is a side sectional view of the image forming apparatus of FIG. 1.

FIGS. 1 and 2 schematically illustrate an image forming apparatus of the present invention, for example, an electronic copying machine. Reference numeral 1 denotes a main body of an electronic copying machine having an original receiving tray transparent glass sheet) 2 fixed on its top. At both ends of the original receiving tray 2 are provided fixed scales 2*a* adapted for reference in placing the originals. Furthermore, an original cover 1*a* and a work table 1*b* are provided in the neighborhood of the original receiving tray 2. An original placed on the original receiving tray 2 is exposed and scanned by an optical system comprised of an exposure lamp 4 and mirrors 5, 6 and 7 when the optical system reciprocates in the directions of arrows a and b along the under surface of the original receiving tray 2. The reflected light from the original obtained by scanning by the optical system, namely, the reflected light from the original which is irradiated by exposure lamp 4 is reflected by mirrors 5, 6 and 7 and further reflected by mirrors 9*a*, 9*b* and 9*c* after passing through a zoom lens 8 to be directed onto a photosensitive drum (image carrier) 10 so that the image of the original is formed on the surface of the photosensitive drum 10.

Under the original receiving tray 2 is provided a known original size sensor 90 which optically senses the size of an original placed on the original receiving tray 2. For example, the sizes of A3, A4, B4, B5 and A5 can be detected. The photosensitive drum 10 rotates in the direction of an arrow c as shown and has its surface charged first by a discharger 11. An image is then projected on the photosensitive drum 10 by use of the slit exposure to form an electrostatic latent image on the surface of the drum 10. The electrostatic latent image is made visible by attracting and holding developing powder, i.e., toner supplied from developers 12*a* and 12*b*.

Copying paper (image forming media) is housed in an upper paper feed cassette 13*a*, a middle paper feed cassette 13*b* and a lower paper feed cassette 13*c*. The copying paper is fed by means of a feed roller 14*a*, 14*b*, 14*c* and a roller pair 15*a*, 15*b*, 15*c* to a regist roller pair 17 via a paper guide passage 16*a*, 16*b*, 16*c*. The regist roller pair 17 in turn guides the paper to the transfer section including the photosensitive drum 10. Paper feed cassettes 13*a*, 13*b* and 13*c* are removably provided at the lower end portion on the right hand side of main body 1 and any one of the paper feed cassettes can be selected by operating the console panel to be described later. Paper feed cassettes 13*a*, 13*b* and 13*c* are sensed for size by cassette size sensing switches 60*a*, 60*b* and 60*c*, respectively. Each of the cassette size sensing switches 60*a*, 60*b* and 60*c* is comprised of a plurality of microswitches which are turned on and off when each of the cassettes of different sizes is loaded.

The paper fed to the transferring section contacts the surface of the photosensitive drum 10 at the portion of a transfer charger (transferring means) 18 so that the toner image on the photosensitive drum 10 is transferred to the paper by the action of the charger 18. The image-transferred paper is separated from the photosensitive drum 10 electrostatically by a separating charger 19 and is carried by a paper carrying belt 20 to a fixing roller 21 serving as a fixing device where the transferred image is fixed. The paper subjected to fixing is discharged to an outlet tray 25 outside the main body 1 by a feed roller pair 22. After the image transfer is completed the photosensitive drum 10 has its residual toner removed by a cleaner 26 and its residual image is erased by a discharge lamp 27 so that it is brought to the initial state. A cooling fan 29 is provided for avoiding an increase in temperature within the main body 1.

Figure 3:
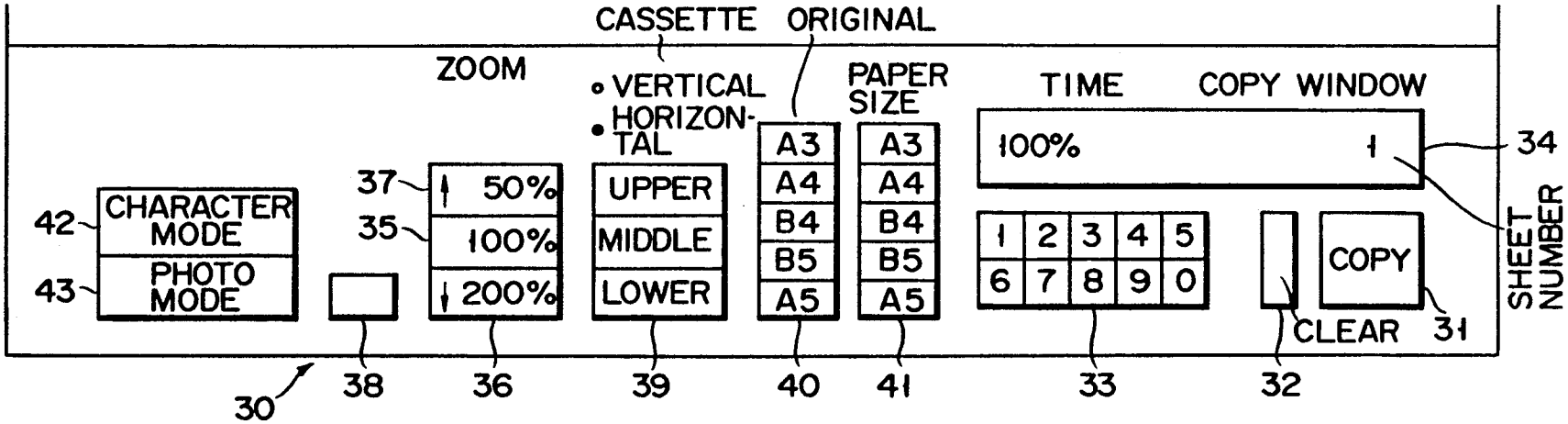
FIG. 3 is a plan view of a console panel of the image forming apparatus of FIG. 1.

FIG. 3 illustrates a console panel 30 of the main body 1. The console panel comprises: a copy key 31 for specifying the initiation of copying; a clear key 32 for clearing setting of the number of copies; ten keys 33 for setting the number of copies; a liquid crystal display 34 for displaying copying magnification, copying time, the number of copies or copying operation guidance; a one-to-one magnification key 35 for specifying copying in one-to-one magnification; a magnification changing key 36 for reducing the copying magnification displayed on the display 34 in units of 1%; a magnification changing key 37 for increasing the copying magnification displayed on the display 34 in units of 1%; a page continuous copying key 38 for specifying continuous copying of pages (a special function); a cassette select key 39 for selecting one of paper feed cassettes 13*a*, 13*b* and 13*c*; an original size display 40 for displaying the size of an original to be copied placed on the document receiving plate 2; a paper size display 41 for displaying the size of paper in a paper feed cassette selected by cassette select key 39; a character mode key 42; and a photo mode key 43. The copying magnification can be set in the range from 50% to 200%. The page continuous copying key 38, cassette select key 39, character mode key 42 and photo mode key 43 are illuminated keys.

Figure 4:
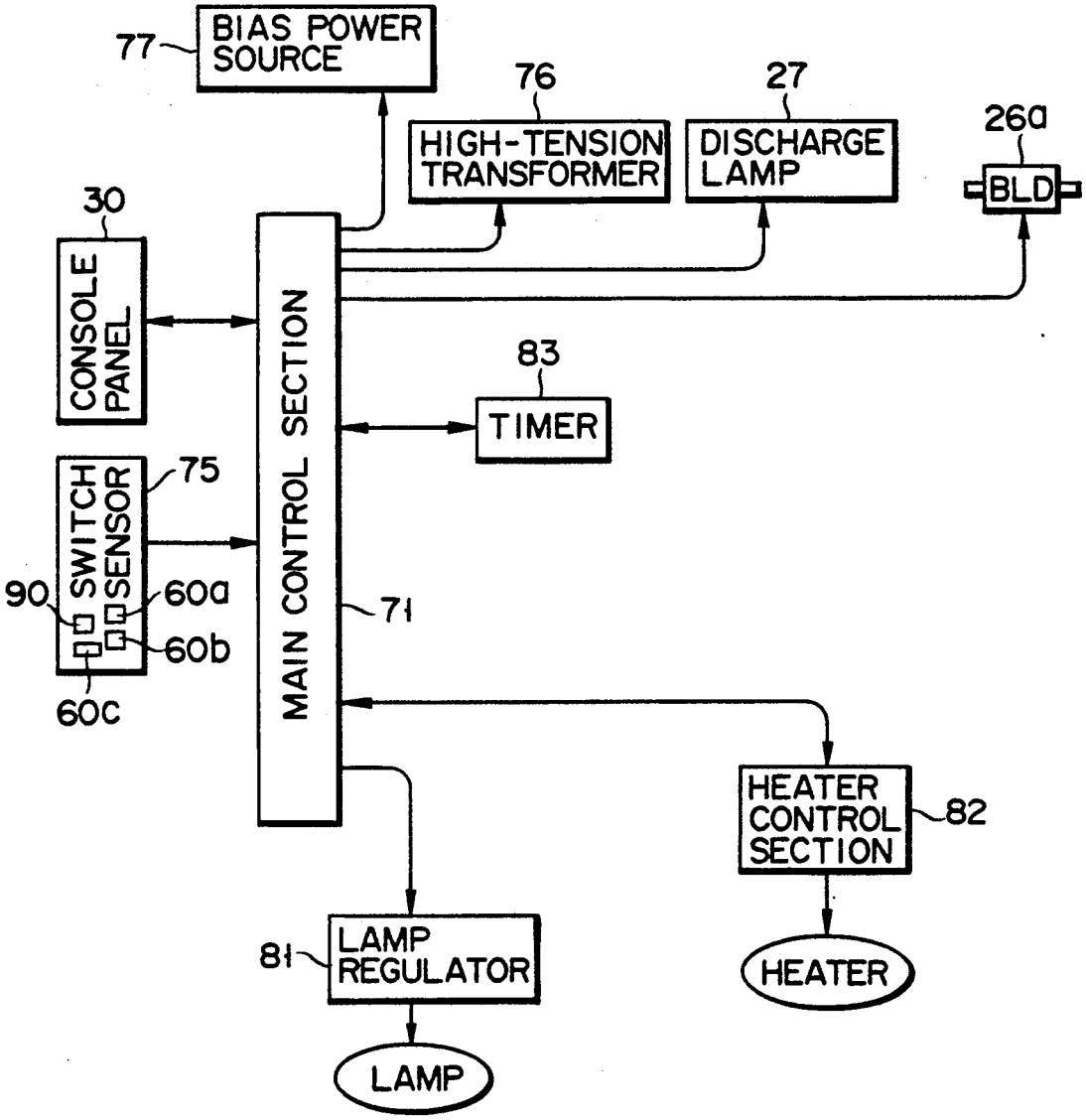
FIG. 4 is a block diagram of a control circuit of the image forming apparatus of FIG. 1.

FIG. 4 illustrates an overall control circuit. A main control section 71 detects input signals from the console panel 30 and an input device 75 comprised of various switches and sensors such as an original size sensor 90, cassette size sensing switches 60*a*, 60*b* and 60*c* and so on, and controls a high-tension transformer 76 for driving each of the dischargers, a bias power source 77, a discharge lamp 27, a blade solenoid 26*a* of a cleaner 26, a heater 23*a* of a fixing roller pair 23 and an exposure lamp 4 to thereby perform the above-described copying operation. The exposure lamp 4 is connected to the main control section 71 via a lamp regulator 81 and the heater 23*a* is connected to the main control section 71 via a heater controller 82.

The main control section 71 controls the display of the original size display 40 of the console panel 30 in accordance with the size of an original sensed by the original size sensor 90. For example, when the original is A4 in size, the original size display 40 displays "A4". The main control section 71 also controls the display of the paper size display 41 on the console panel 30 in accordance with the paper size of a paper feed cassette selected by cassette select key 39. For example, when a lower paper feed cassette 13*c* containing A4-size paper is selected, "A4" is displayed. In addition, the main control section 71 decides a copying time according to the copying magnification, the number of copies and the continuous copying of pages, i.e., the time required until the last paper has been discharged after the completion of all of copies, displays the decided copying time on the display 34 and decrements the copying time displayed on the display 34 by one second in response to a signal supplied from the timer 83 every second.

Figure 5:
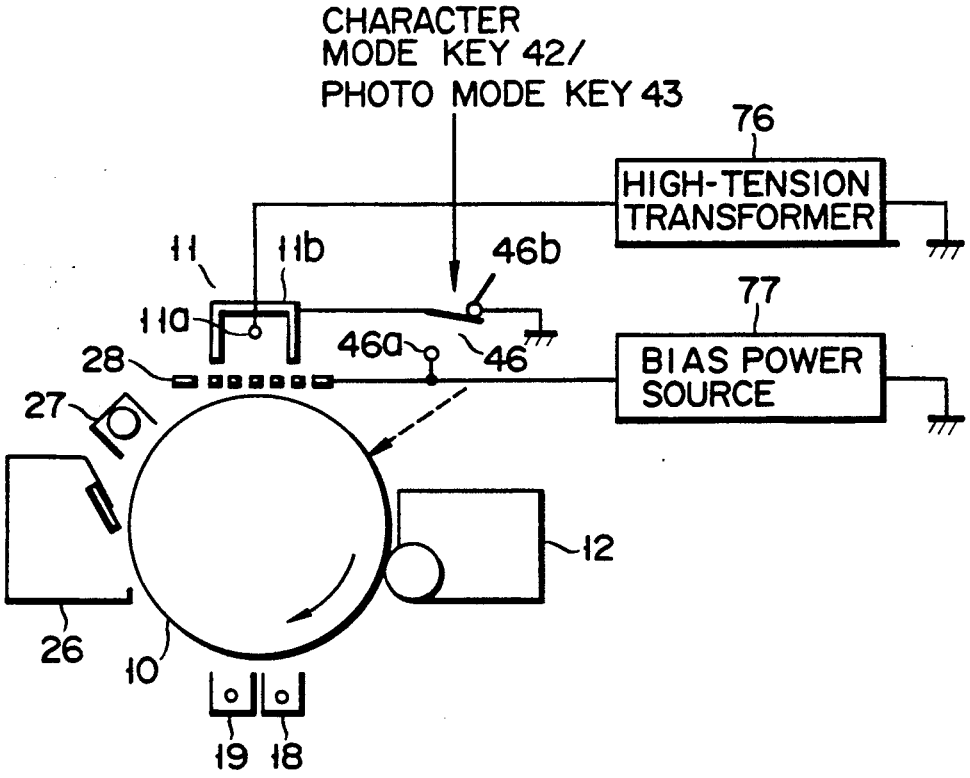
FIG. 5 is a schematic view of the surface potential control device for a photosensitive body embodying the present invention.

FIG. 5 is a schematic diagram of a surface potential control device for a photosensitive body, which illustrates an embodiment of the present invention taking an electronic copying machine by way of an example. A corona discharger 11 is comprised of a corona wire 11*a* and a shielding case 11*b* which surrounds the corona wire 11*a* from its three sides except the side facing the photosensitive body 10. The corona wire 11*a* is supplied with an output of the high-tension transformer 17. The shielding case 11*b* is electrically conductive. Between the corona discharger 11 and the photosensitive body 10 is provided a screen grid 28 which is supplied with an output of a bias power source (supplying means) 77. The output of the bias power source 77 is also supplied to the shield case 11*b* via a switch (control means) 46. The connection of the switch 46 is changed over by operating the character mode key 42 and the photo mode key 43 on the console panel 30.

In operation of the surface potential control device of the present invention, when the character mode, i.e., the normal mode is set, the moving contact of the switch 46 is brought into contact with a contact 46*a* by the character mode setting key 42. Thus, a predetermined direct-current voltage is supplied from the bias power source 77 to the shielding case 11*b* of the corona discharger 11 via the contact 46*a* of the switch 46 as well as the screen grid 28. Under this condition, when the photosensitive body 10 is rotated in the direction of an arrow as shown, its surface is uniformly charged by the corona discharger 11. In this case, the surface of the photosensitive body 10 is charged to a potential corresponding to an output direct-current voltage of the high-tension transformer 17 which is applied to the corona wire 11*a* of the corona discharger 11.

When, on the other hand, an original is imaged onto the photosensitive body 10 as shown by a dashed line, an electrostatic latent image is formed on the surface of the photosensitive body 10. The electrostatic latent image formed on the photosensitive body 10 is attached and developed by a toner when facing a developing device 12. The developed toner image is sent to the position facing the transfer charger 18 as the photosensitive body 10 rotates. By the action of the transfer charger 18 the toner image on the photosensitive body 10 is transferred to a sheet of copying paper not shown. The toner-image transferred paper is separated from the surface of the photosensitive body 10 by the separating charger 19. The paper is discharged to the outside of the main body 1 after the toner image has been fixed. The photosensitive body 10 has its surface residual toner which is removed by a cleaner 26 after the toner image has been transferred to the copying paper. Furthermore, the charge on the photosensitive body 10 is discharged by the discharge lamp 27 to make ready for the next copying operation.

Figure 6:
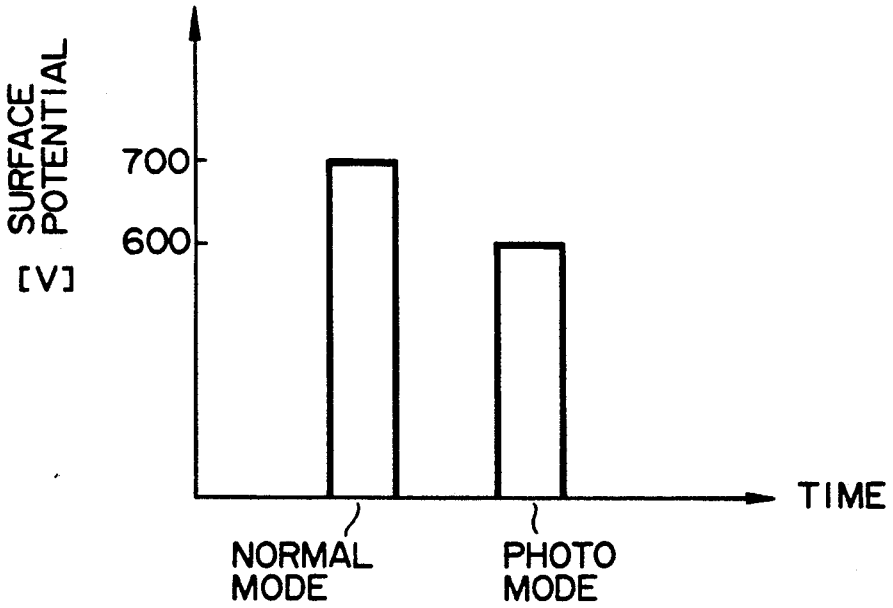
FIG. 6 is a diagram illustrating a difference in surface potential between the normal and photo modes.

When the photo mode is set by photo mode key 43 on the console panel 30, on the other hand, the moving contact of the switch 46 is switched from the contact 46*a* to the contact 46*b* so that the shielding case 11*b* of the corona discharger 11 is connected to ground. Thus, part of the discharge voltage from the corona discharger 11 produces a current which is passed to ground via the shielding case 11*b*. Accordingly, as shown in FIG. 6, the surface potential of the photosensitive body 10 will be lowered to about 600 volts where the surface potential is assumed to be 700 volts in the normal mode. As a result, the halftones of an photographic original can be reproduced to thus obtain good copied images.

As described above, an equal voltage is applied to the shielding case 11*b* and the screen grid 28 when the normal mode is set, while the switch 46 is changed over to connect the shielding case 11*b* to ground when the photo mode is set. Thereby, part of the discharge voltage from the corona discharger 11 is passed to ground in the photo mode. It is therefore possible to make the surface potential of the photosensitive body 10 in the photo mode in which the shielding case 11*b* is grounded lower than that in the normal mode in which the shielding case 11*b* of the corona discharger 11 is at a potential corresponding to the output direct-current voltage of the high-tension transformer 76.

As described above, by controlling a voltage applied to the shielding case 11*b*, the surface potential of the photosensitive body 10 can be varied. Accordingly, good copies can be provided inexpensively without using a feedback control transformer and a feedback circuit.

Additional advantages and modifications will readily occur to those skilled in the art. Therefore, the invention in its broader aspects is not limited to the specific details, representative devices, shown and described herein. Accordingly, various modifications may be made without departing from the spirit or scope of the general inventive concept as defined by the appended claims and their equivalents.

What is claimed is:

1. An image forming apparatus having character and photo modes of operation, comprising:

an image carrier having a surface on which an image is formed, said surface of said image carrier have a predetermined surface potential to form said image;

first potential source means for supplying a predetermined high direct-current voltage;

second potential source means for supplying a bias direct-current voltage;

third potential source means for supplying a ground voltage;

means, connected to said first potential means, for charging said surface of said image carrier;

means for shielding said charging means electrically;

means, disposed between said charging means and said image carrier and connected to said second potential source means, for preventing nonuniform charging of said surface of said image carrier which is caused by said charging means; and means, connected to said second and third potential source means, for switching an electric potential level of said shielding means between the voltages supplied from said second and third potential source means so as to control the surface potential of said image carrier in response to said character and photo modes.

2. An image forming apparatus according to claim 1, wherein said switching means connected said shielding means to said second and third potential source means in response to said character and photo modes, respectively.

3. An image forming apparatus according to claim 1, wherein said image carrier has a photosensitive body.

4. An image forming apparatus according to claim 1, wherein said first potential source means comprises a high-tension transformer.

5. An image forming apparatus according to claim 1, wherein said second potential source means comprises a bias power source.

6. An image forming apparatus according to claim 1, wherein said third potential source means comprises a ground.

7. An image forming apparatus according to claim 1, wherein said charging means comprises corona discharging means disposed in the proximity of the surface of said image carrier.

8. An image forming apparatus according to claim 1, wherein said preventing means comprises a screen grid.

9. An image forming apparatus according to claim 1, wherein said preventing means and said shielding means are disposed in parallel between said charging means and said image carrier.

10. An image forming apparatus having character and photo modes of operation, comprising:

an image carrier having a surface on which an image is formed, said surface of said image carrier have a predetermined surface potential to form said image;

first potential source means for supplying a predetermined high direct-current voltage;

second potential source means for supplying a bias direct-current voltage;

third potential source means for supplying a ground voltage;

means, connected to said first potential means, for charging said surface of said image carrier;

means for shielding said charging means electrically;

means, disposed between said charging means and said image carrier and connected to said second potential source means, for preventing nonuniform charging of said surface of said image carrier which is caused by said charging means; and means, connected to said second and third potential source means, for setting said shielding means and said preventing means at the same electric potential when said character mode of operation is selected.

11. An image forming apparatus according to claim 10, wherein said same electric potential is supplied by said second potential source means.

* * * * *